United States Patent [19]

Dauvergne

[11] 4,167,909

[45] Sep. 18, 1979

[54] SOLID FUEL BURNER

[76] Inventor: Hector A. Dauvergne, P.O. Box 884, San Leandro, Calif. 94577

[21] Appl. No.: 913,398

[22] Filed: Jun. 7, 1978

Related U.S. Application Data

[63] Continuation-in-part of Ser. No. 749,066, Dec. 9, 1976, Pat. No. 4,098,200.

[51] Int. Cl.[2] ..... F23G 5/04; F23J 5/02

[52] U.S. Cl. ..... 110/207; 110/228; 110/257

[58] Field of Search ..... 110/204, 207, 224, 228, 110/248, 255, 257

[56] References Cited

U.S. PATENT DOCUMENTS

| | | | |
|---|---|---|---|
| 3,344,758 | 10/1967 | Wotschke | 110/227 |
| 3,777,676 | 12/1973 | Lagen | 110/255 |
| 3,861,332 | 1/1975 | Itasaka | 110/227 |
| 3,877,398 | 4/1975 | Ochi et al. | 110/257 |

*Primary Examiner*—Kenneth W. Sprague
*Attorney, Agent, or Firm*—Bielen and Peterson

[57] ABSTRACT

A solid fuel burner utilizing at least two stacked chambers one of which contains a combustion bed for the solid fuel burning process. A second chamber below the first bed containing chamber serves to combust volatile gases unburned in the first chamber with the aid of an oxidizing rejector.

5 Claims, 1 Drawing Figure

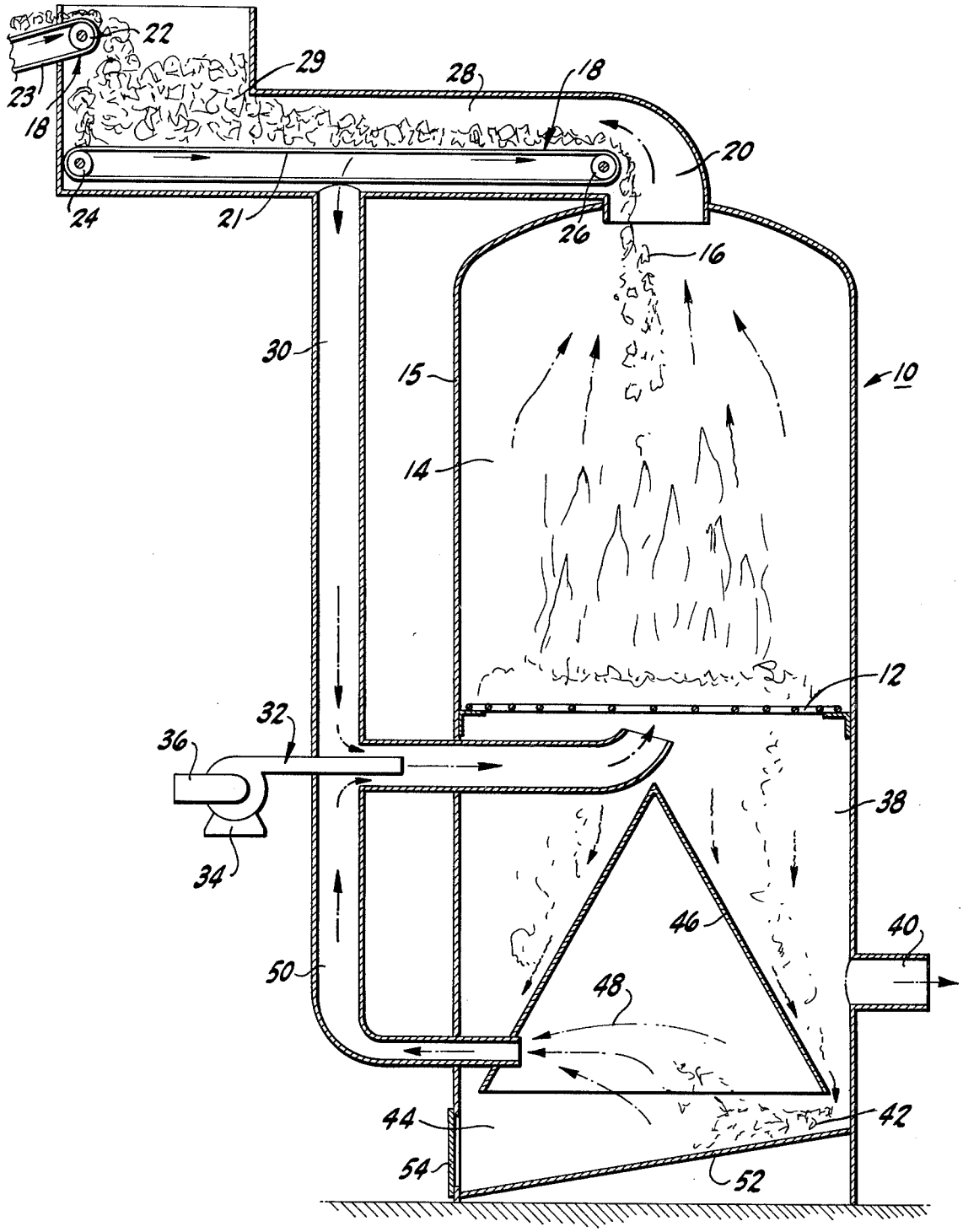
22
23
18
29
28
18
20
24
21
26
16
30
15
10
14
12
32
36
38
34
46
40
50
48
44
42
54
52

SOLID FUEL BURNER

CROSS REFERENCES TO RELATED INVENTION

The present application is a continuation-in-part of my pending application Ser. No. 749,066, filed Dec. 9, 1976, now U.S. Pat. No. 4,098,200.

BACKGROUND OF THE INVENTION

The present invention relates to the art of the combustion of solid fuels.

Solid fuel burners such as incinerators have been used to dispose of waste products such as garbage, sawdust, and the like. Prior devices have used more than one chamber to oxidize solid fuel but have not employed massive recycling of exhaust gases from one chamber to another. Likewise, none of the references combines the recycling of gases from a primary combustion chamber and volatile gases from ash collectors simultaneously.

SUMMARY OF THE INVENTION

In accordance with the present invention, a novel solid fuel burner is provided. The burner of the present invention utilizes a first combustion bed located within a first combustion chamber. The first combustion bed may define the lower periphery of the first combustion chamber. A second combustion chamber is located adjacent the first combustion chamber. The second combustion chamber burns gaseous products from the first combustion chamber by a recycling mechanism which will be hereinafter described.

A third chamber may be positioned below the second combustion chamber to collect ash from the burning processes taking place on the combustion bed found in the first combustion chamber.

The invention may further include means for recycling gases from the first and/or third chambers for burning in the second chamber. Recycling means may take the form of an air ejector which would also serve to provide the proper amount of oxidizing gas, eg. oxygen, such that all the incompletely combusted gaseous components of the first and/or third chamber solid fuel combustion are completely oxidized. The solid fuel burner may also include means for exhausting gases from the second chamber such that they may be used to run a turbine or any other mechanical device deriving motivation from moving fluids.

The first combustion bed may consist of a grate having the desired mesh size such that the finer ash component of the unburned fuel in the first chamber eventually travels to the third chamber where it is removed. The ash volatile gases may be withdrawn from the third chamber with the use of a fume hood and forced into the air ejector as heretofore described.

A mechanical conveyor may be used to feed the first chamber with the solid fuel as desired. Such a conveyer may be placed within the flow conduit from the first chamber which leads into the air ejector for recycling. Incomplete combustion would generally take place in the first chamber and complete combustion in the second chamber. The third chamber is normally used to gather the ash which is considered an unburnable component. It has been found that the burner of the present invention produces controllable amounts of nitrogen oxides as well as the normal carbon dioxide and water byproducts of organic combustion.

It may be apparent that a new and useful solid fuel burner has been described.

It is therefore an object of the present invention to provide an apparatus which utilizes multichamber combustion to minimize the production of nitrogen oxides as a combustion product.

It is another object of the present invention to provide a solid fuel burner which conserves the heat of combustion of one chamber by utilizing the same in a second chamber.

It is yet another object of the present invention to provide a solid fuel burner which oxidized the volatile gases found in ash byproducts to produce useful energy therefrom.

It is yet another object of the present invention to provide a solid fuel burner which uses an air ejector to recycle the gases from incompletely combusted solid fuel and volatile gases from ash components and to mix said gases with the stoichiometric quantities of oxidizing gases necessary for the complete combustion of the gases being delivered by the ejector mechanism.

The invention has other objects and advantages especially as concerns particular features and characteristics thereof, which will become apparent as the specification continues.

BRIEF DESCRIPTION OF THE DRAWINGS

FIG. 1 is a side elevational view of the solid fuel burner apparatus.

For a better understanding of the invention, reference is made to the following detailed description.

DESCRIPTION OF THE PREFERRED EMBODIMENTS

With reference to the drawings, the apparatus as a whole is denoted by reference character 10 and includes as one of its elements a combustion bed 12 found in a first chamber 14. Chamber wall 15 may be constructed of metallic substances such as steel, bronze, and the like. First chamber 14 receives solid material 16 from conveyor means 18 via the flue 20 of first chamber 14. Conveyor means 18 may include belts 21 and 23 and rollers 22, 24, and 26. Conveyor means 18 is run by any conventional mechanical means. Gases from first chamber 14 are prevented from escaping through conveyor conduit 28 by a series of barriers or gates, or the accumulation 29 of solid fuel 16, well known in the art.

First chamber 14 incompletely combusts the solid material 16 which falls to bed 12 by gravitational means. Combustion gases produced from this incomplete combustion may include carbon monoxide, carbon dioxide, carbon black, unburned hydrocarbons, and certain lesser oxides of other materials. Since the temperature of first chamber 14 remains in the area of about 1000° C., oxides of nitrogen are not generally formed therein. Gases from first chamber flow through flue 20 to recycling conduit 30 and to ejector means 32. Ejector means 32 may include blower 34 having an inlet 36 to deliver oxidizing gases such as free oxygen or oxygen-bearing air to second chamber 38.

Second chamber 38 is defined as being below first combustion bed 12. Second combustion chamber 38 burns at a higher temperature than first chamber 14, ie: 1350 to 1400° C. At this temperature, some nitrogen oxides are formed but the amounts of the same are minimal. Second chamber 38 also includes means 40 for exhausting gases therefrom which have been combusted. The action of ejector 32 creates a slight overpressure in chamber 38 and a slight vacuum in chamber 14. Exhaust gases from second chamber 38 may be used to run a turbine or other mechanical devices requiring high velocity fluids for motivation.

Returning to the flow of solids 16, it may be seen that such solids 16 initially fall onto first combustion bed 12, at the base of chamber 14. Combustion bed 12 may be constructed in the form of a grate having a relatively coarse mesh such that the final unburned particles or ash 42, therefrom pass therethrough to third chamber 44. Combustion bed 12 may be constructed to rotate, known in the art (not shown). Second chamber 38 communicates with third chamber 44 to permit the transfer of ash 42 from second chamber 38 to third chamber 44. Third chamber 44 may include a fume hood 46 which collects the volatile gaseous components 48 of the ash 42. Such volatile gases 48 are recycled to second chamber 38 via recycling conduit 50. Ash 42 is held by inclined base 52 and may be removed from third chamber 44 via access door 54. It may be apparent that third chamber 44 is under a slight vacuum due to the aspirating action of ejector 32.

Second chamber 38 is the hottest portion of the burner 10. The stoichiometric need of the gases being combusted in second chamber 38 is substantially reduced by the partial oxidation occurring in the first chamber 14. By this expedient, the temperature of second chamber 38 is maintained at a relatively low level for an incinerator. As heretofore described, this dramatically reduces the production of harmful nitrogen oxide gases which tend to form at higher temperatures.

In operation, the solid fuel is delivered to first chamber 14 via conveyor means 18. Solid fuel 16 is deposited on the combustion bed 12 and partially oxidized. Gases from first chamber 14 are recycled via ejector means 32 into second chamber 38. The stoichiometric needs of the gases entering second chamber are met by provision of oxidizing gases to blower inlet 36. Smoke and volatile gases from the ash 42 found in the third chamber 44 are recycled via conduit 50 into second chamber 38 for combustion as well. Gases being exhausted from second chamber 38 are employed to produce mechanical and/or electrical energy via exhaust means 40.

While in the foregoing specification embodiments of the invention have been set forth in considerable detail for the purposes of making a complete disclosure of the invention, it will be apparent to those of ordinary skill in the art that numerous changes may be made in such details without departing from the spirit and principals of the invention.

What is claimed is:

1. A solid fuel burner comprising:

a. A combustion bed;

b. a first combustion chamber encompassing said first combustion bed;

c. a second combustion chamber located adjacent said first combustion chamber;

d. means for delivering solid fuel into said first chamber and onto said combustion bed;

e. means for recycling gaseous products from the combustion of the solid fuel in said first chamber to said second chamber;

f. means for exhausting gaseous matter from said second chamber to a space externally located, with respect to the solid fuel burner;

g. means for providing gaseous matter for the oxidation of said solid fuel;

h. a third chamber formed adjacent said second chamber by a partition, said third chamber communicating with said second chamber to permit the transfer of solids therefrom, and said gaseous products recycling means further includes means for recycling gaseous matter from said third chamber to said second chamber.

2. The solid fuel burner of claim 1 in which said recycling means includes air ejection means for removing the gaseous matter from said first and third chambers.

3. The solid fuel burner of claim 2 in which said partition forming said third chamber comprises a fume hood.

4. The solid fuel burner of claim 1 in which said solid fuel delivering means comprises a mechanical conveyor located above said first combustion bed and includes entry means for delivering the solid fuel to the upper portion of said first chamber.

5. The solid fuel burner of claim 4 which additionally comprises means for removing ash from said third chamber.

* * * * *